US008292311B2

(12) United States Patent
De Las Casas

(10) Patent No.: US 8,292,311 B2
(45) Date of Patent: Oct. 23, 2012

(54) SKATEBOARD TRUCK

(76) Inventor: Armando De Las Casas, Sunland, CA (US)

( * ) Notice: Subject to any disclaimer, the term of this patent is extended or adjusted under 35 U.S.C. 154(b) by 364 days.

(21) Appl. No.: 12/604,180

(22) Filed: Oct. 22, 2009

(65) Prior Publication Data

US 2011/0095500 A1 Apr. 28, 2011

(51) Int. Cl.
*B62M 1/00* (2010.01)

(52) U.S. Cl. ..... 280/87.042

(58) Field of Classification Search ..... 280/87.01, 280/87.021, 87.03, 87.041, 87.042, 11.28
See application file for complete search history.

(56) References Cited

U.S. PATENT DOCUMENTS

| | | | | |
|---|---|---|---|---|
| 2,373,220 | A * | 4/1945 | Blaes | 280/11.27 |
| 3,862,763 | A * | 1/1975 | Ware | 280/11.28 |
| 4,159,830 | A * | 7/1979 | Solimine | 280/11.28 |
| 4,278,264 | A * | 7/1981 | Lenz | 280/11.28 |
| 4,398,734 | A * | 8/1983 | Barnard | 280/11.28 |
| 5,029,882 | A * | 7/1991 | Marandel | 280/11.209 |
| 6,367,819 | B1 * | 4/2002 | Andersen et al. | 280/11.28 |
| 6,467,782 | B1 * | 10/2002 | Smith | 280/87.042 |

* cited by examiner

*Primary Examiner* — Frank Vanaman
(74) *Attorney, Agent, or Firm* — James A. Italia; Italia IP

(57) ABSTRACT

A skateboard truck includes a hanger and a truck plate. The hanger includes a yoke with a first yoke portion and a second yoke portion. The truck plate includes a first connection portion slideably connected to the first yoke portion through a shock absorber. The truck plate also includes a second connection portion connected to the second yoke portion through a connecting bar. The connecting bar is rotatably connected to the truck plate.

1 Claim, 5 Drawing Sheets

SKATEBOARD TRUCK

FIELD OF THE INVENTION

The field of this invention is skateboard trucks, and in particular the field is skateboard trucks with suspension systems.

BACKGROUND OF THE INVENTION

Skateboards today are ridden over many surfaces and used to perform many tricks. Most skateboards have a deck where the rider stands and two trucks which connect the wheels to the deck. When riding over bumps and other obstacles, and performing tricks, such as jumps, the skateboard can transmit many mechanical shocks to the rider. These shocks can distract the rider and cause the rider to lose concentration. Trucks which dampen the mechanical trucks can assist a rider.

SUMMARY OF THE INVENTION

A skateboard truck including a hanger and a truck plate is disclosed. The hanger includes a yoke with a first yoke portion and a second yoke portion. The truck plate includes a first connection portion slideably connected to the first yoke portion through a shock absorber. The truck plate additionally includes a second connection portion connected to the second yoke portion through a connecting bar. The connecting bar is rotatably connected to the truck plate.

BRIEF DESCRIPTION OF THE DRAWINGS

The accompanying drawings, which are incorporated in and constitute a part of this specification, illustrate exemplary embodiments or features of the disclosure and, together with the description, help explain principles of the disclosure. In the drawings.

DETAILED DESCRIPTION

Reference will now be made in detail to specific embodiments or features, examples of which are illustrated in the accompanying drawings. Generally, the same or corresponding reference numbers will be used throughout the drawings to refer to the same or corresponding parts.

Figure 1:
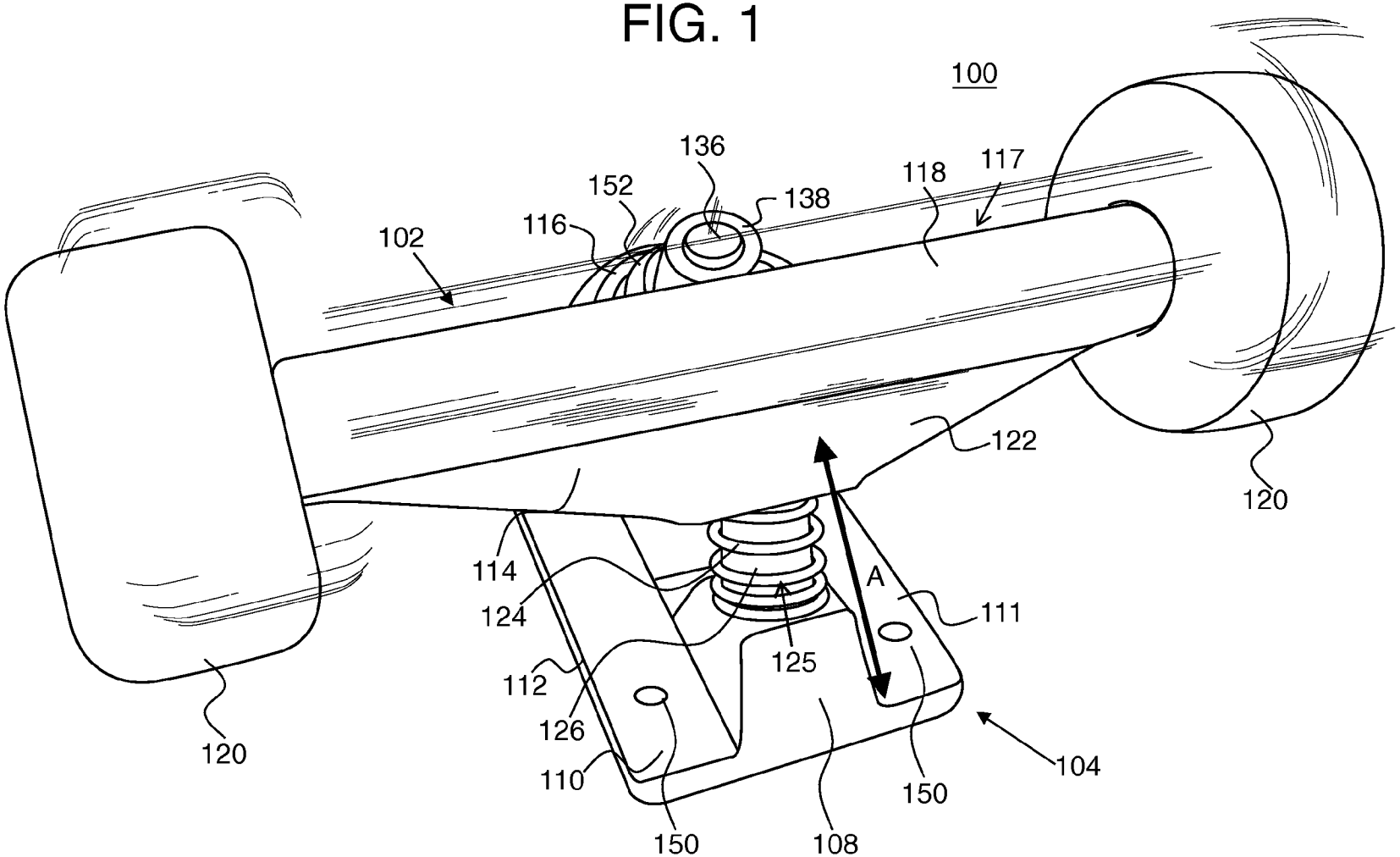
FIG. 1 depicts a first side view of an exemplary embodiment of a skateboard truck.

Referring now to FIG. 1, a first side view of an exemplary embodiment of a skateboard truck 100 is depicted. The truck 100 may include any device which mounts to the underside of a skateboard deck (not shown), that wheels 120 may be attached to. The truck 100 may be one of a pair of devices which allow a skateboarder to turn a skateboard by leaning.

In the depicted embodiment, the truck 100 includes a hanger 102 and a truck plate 104. The hanger 102 includes a yoke 117, an axle (not shown), and wheels 120.

In one embodiment the yoke 117 may include aluminum material. In other embodiments the yoke 117 may include other metals, for example steel, brass, or an alloy. In some embodiments the yoke 117 may include nylon materials. The yoke 117 may include any materials that would be known by an ordinary person skilled in the art.

In one embodiment formation of the yoke 117 includes casting from a suitable material, heat treating, and then machining. The machining may include grinding, polishing, and drilling. In other embodiments the yoke 117 may be formed from sheet metal and may then be machined. The yoke 117 may be formed in any way that would be known by an ordinary person skilled in the art.

In the depicted embodiment, the yoke 117 includes a middle portion 118, a first yoke portion 114, and a second yoke portion 116. The axle runs through an aperture (not shown) in the middle portion 118 and attaches to the wheels.

Figure 2:
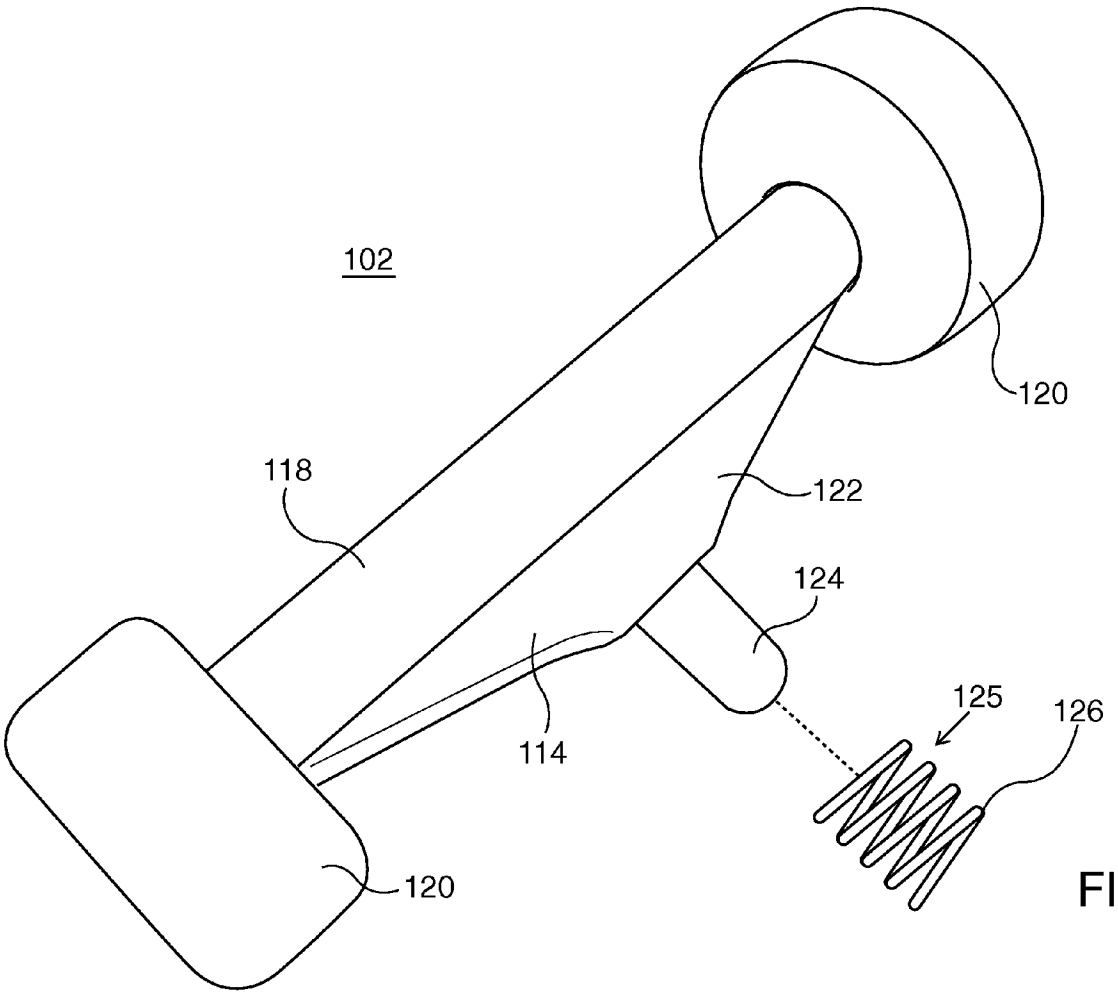
FIG. 2 depicts an expanded first side view of an exemplary embodiment of a skateboard truck yoke and shock absorber.

Referring now to FIG. 2, an expanded first side view of an exemplary embodiment of the yoke 117 and a shock absorber 125 is depicted, showing the first yoke portion 114 more clearly. The first yoke portion 114 includes a main portion 122 and a protruding member 124.

In the depicted embodiment, the protruding member 124 includes an elongated generally cylindrical member attached to the main portion 122. The protruding member 124 may be cast along with other portions of the yoke 117, or it may be formed separately and welded or attached in some other way which would be known by an ordinary person skilled in the art.

In the depicted embodiment the main portion 122 includes a generally triangular type shape with a corner cut away. The protruding member 124 is attached at the cut away corner. The main portion 122 edge opposite the cut away corner is attached to the middle portion 118. The main portion 122 may be cast along with other portions of the yoke 117, or it may be formed separately and welded or attached in some other way which would be known by an ordinary person skilled in the art.

The shock absorber 125 may include any device designed to smooth out or damp shock impulse and dissipate kinetic energy which would be known to an ordinary person skilled in the art. In the depicted embodiment the shock absorber 125 is a coil spring 126. In other embodiments the shock absorber 125 may include hydraulic or pneumatic devices.

The coil spring 125 may include any mechanical device made of an elastic material formed into the shape of a helix which compresses when loaded on each end and returns to its natural length when unloaded, which would be known to an ordinary person skilled in the art. The coil spring 125 in the depicted embodiment includes a metallic material.

Figure 3B:
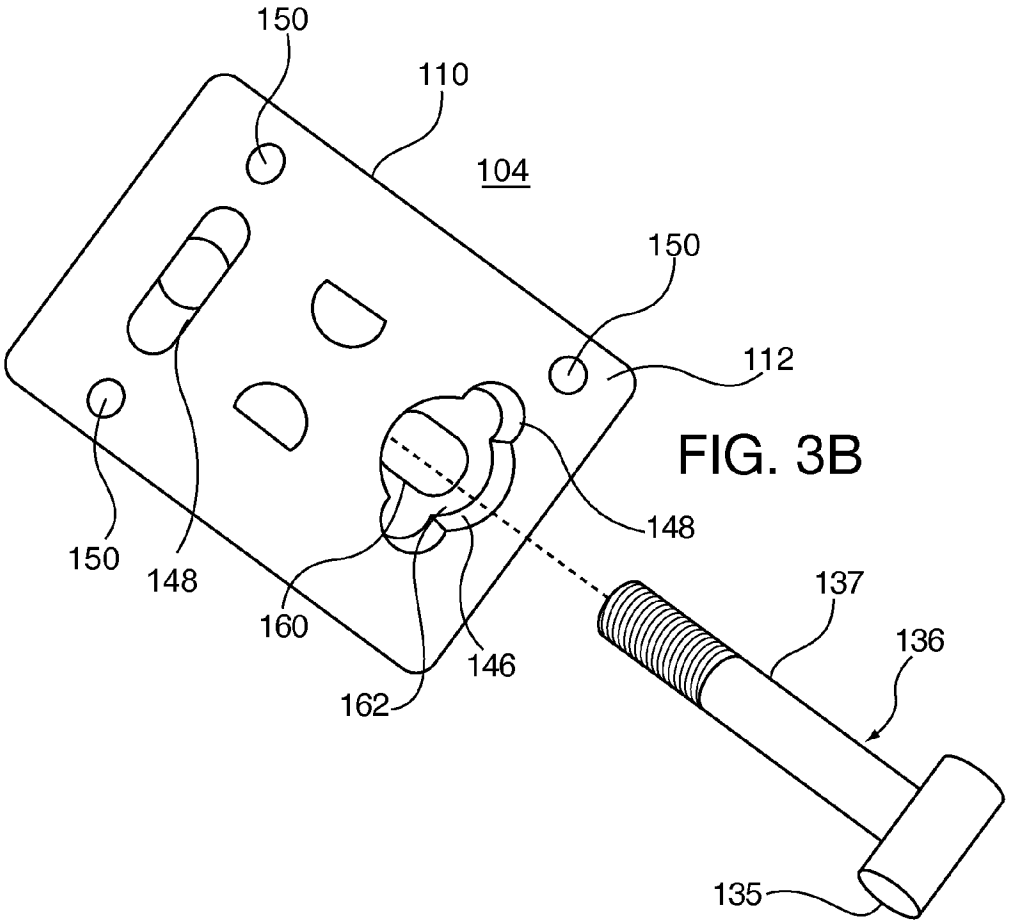
FIG. 3B depicts an exploded back view of an exemplary embodiment of a skateboard truck plate and a kingpin.
Figure 3A:
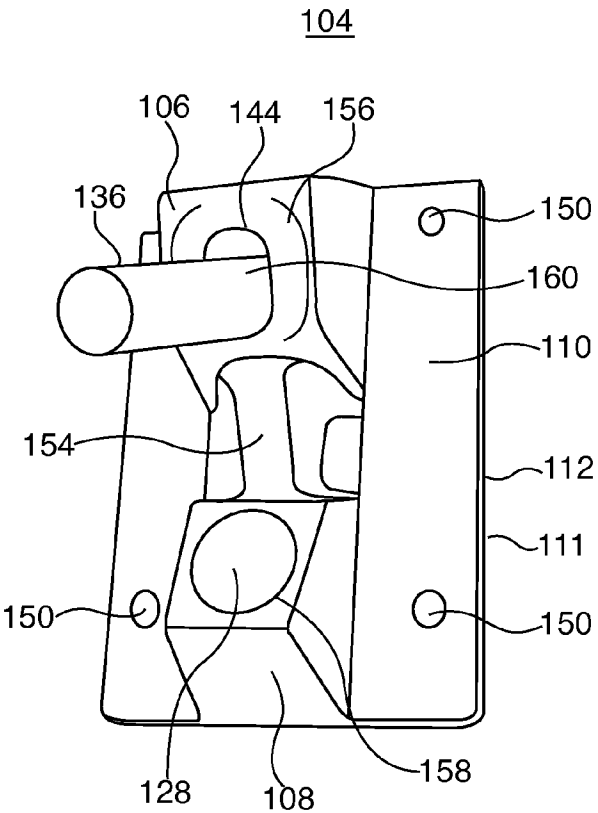
FIG. 3A depicts a front view of an exemplary embodiment of a skateboard truck plate and a kingpin.

Referring now to FIGS. 3A and 3B a front view of an exemplary embodiment of the truck plate 104 and a kingpin 136 and an exploded back view of an exemplary embodiment of the truck plate and the kingpin 136 are depicted. The plate 104 may include any connecting plate designed to connect the skateboard deck to the hanger 102. The plate 104 may include aluminum material. In other embodiments the plate 104 may include other metals, for example steel, brass, or an alloy. In some embodiments the plate 104 may include nylon materials. The plate 104 may include any materials that would be known by an ordinary person skilled in the art.

In one embodiment formation of the plate 104 includes casting from a suitable material, heat treating, and then machining. The machining may include grinding, polishing, and drilling. In other embodiments plate 104 may be formed from sheet metal and may then be machined. The plate 104 may be formed in any way that would be known by an ordinary person skilled in the art.

In the depicted embodiment, the plate 104 includes a base 111, a first connection portion 108, and a second connection portion 106. The first connection portion 108 and the second connection portion 106 protrude from the base 111. A support bar 154 connects the first connection portion 108 and the second connection portion 106. The plate 104 includes a front surface 110 and a back surface 112. The plate 104 includes bolt apertures 150 for securing the plate 104 to the skateboard deck.

The first connection portion 108 includes a first truck plate aperture 128 and a first connection surface 158. In the depicted embodiment, the first plate aperture 128 extends through the first connection portion 108 and the base 111. In other embodiments the first plate aperture 128 may extend only through the first connection portion 108 or a portion of the first connection portion 108. In still other embodiment the first plate aperture 128 may extend partially through the base 111. The distance the first plate aperture 128 extends into the plate 104 may be determined as a function of the desirable maximum distance the protruding member 124 may extend into the plate 104 and the compression characteristics of the coil spring 126, as explained below in further reference to FIG. 1.

The second connection portion 106 includes a second truck plate aperture 144 and a second connection surface 156. In the depicted embodiment, the second plate aperture 144 includes a front aperture section 160, a back aperture section 146, and a slot 148. The front aperture section 160 includes a cross section generally the shape of a rectangle with half circle ends. The front aperture section 160 may be sized to allow the bolt 137 to rotate slightly as is explained below.

In the depicted embodiment, the back aperture section 146 includes a cross section generally circular in shape with a diameter larger than the length of a straight line drawn across any part of the cross section of the front aperture section 160. The back aperture section 146 has a configuration of a slot superimposed over a generally circular form. The shape of the back aperture section 146 allows the insertion of the bolt 137 as is explained below.

In the depicted embodiment, the slot 148 extends from the back surface 112 partially through the plate 104 and intersects the front aperture section 146 and the back aperture section 146, forming a slot surface 162. The first plate aperture 148 is slot shaped and is transversely aligned relative to the length of the base 111.

The kingpin 136 includes a generally elongated member designed to connect the plate 104 to the yoke 117. In the depicted embodiment, the kingpin 136 is a bolt 137 with a T end 135. The T end 135 includes bolt ends that are generally elongated members attached to the bolt perpendicularly, such that the bolt body and the end 135 are in the shape of the letter T.

The bolt 137 may be inserted into the second plate aperture 144 through the back aperture section 146 and slot 148, such that the T end 135 sits on the slot surface 162, and the bolt 137 extends through the front aperture section 160. The bolt 137 is able to rotate slightly around an axis formed through the T end 135 (shown as axis C in FIG. 4). The amount of rotation allowed is dependent on the shape and position of the front aperture section 160.

In alternative embodiments the plate 104 may be different shapes. It may be desirable to keep weight to a minimum and thus for the first connection portion 108 and the second connection portion 106 to protrude from the base 111 with a support bar 154 between them as shown. In an embodiment where weight is not a primary issue, the plate 104 may be a solid generally rectangular shaped block. An ordinary person skilled in the art will know many shapes which the plate 104 may take in alternative embodiments.

Returning now to FIG. 1, the first connection portion 108 is slideably connected to the first yoke portion 114 through the shock absorber 125. In the depicted embodiment, the protruding member 124 slidingly extends through the coil spring 126 into the first plate aperture 128. One end of the coil spring 126 sits on the first connection surface 158. The other end of the coil spring 126 abuts the main portion 122. The hanger 102 may move up and down in relation to the plate 104 along axis A as the coil spring 126 compresses and expands. As the coil spring 126 compresses and expands, the protruding member 124 may slide up and down in the first plate aperture 128.

In other embodiments different type shock absorbers 125 may be used in place of the coil spring 126. In other embodiments different connection alternatives which slideably connect the first connection portion 108 to the first yoke portion 114 are also contemplated. These alternatives would be known by an ordinary person skilled in the art.

Figure 4:
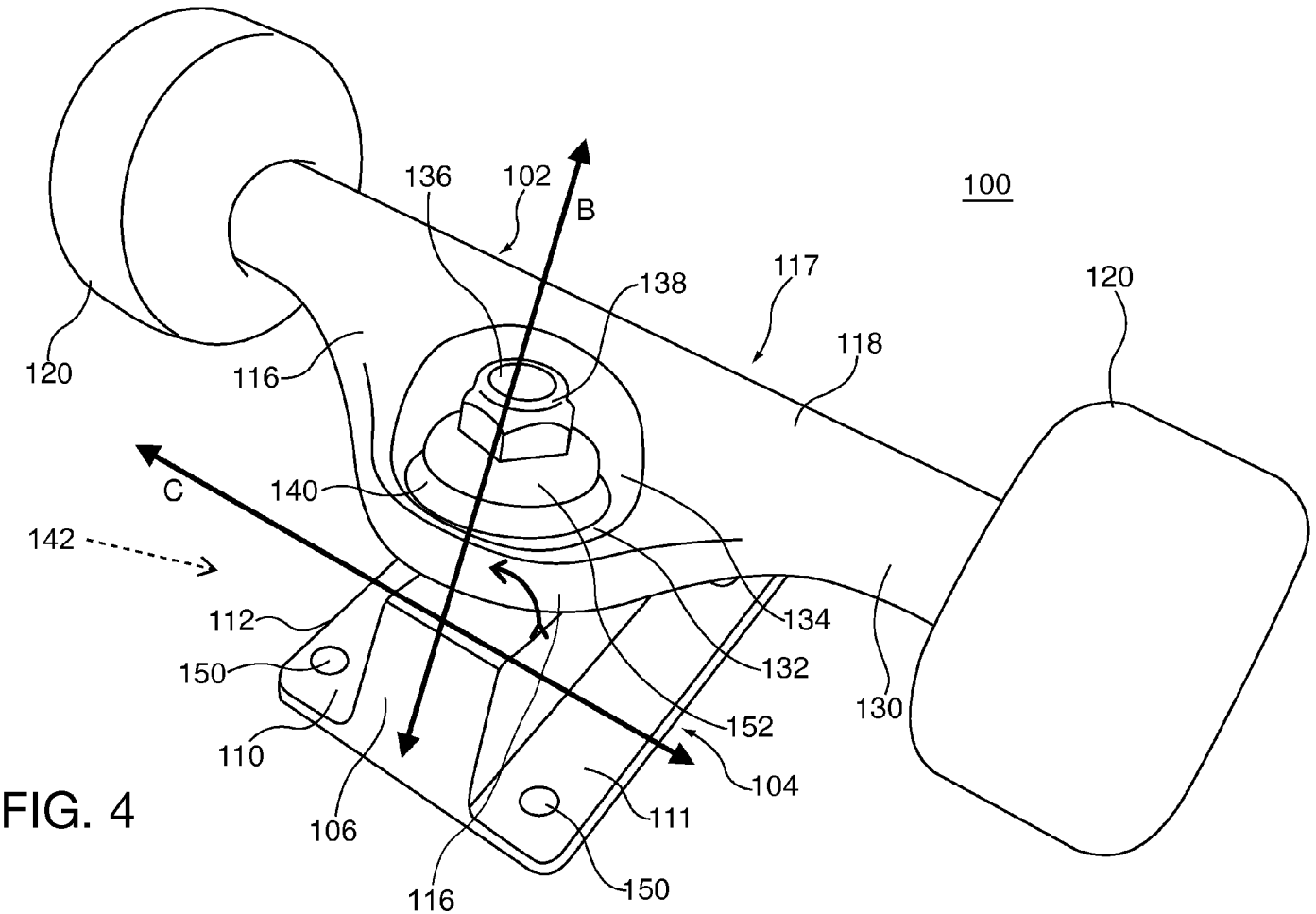
FIG. 4 depicts a second side view of an exemplary embodiment of skateboard truck.

Referring now to FIG. 4, a second side view of an exemplary embodiment of skateboard truck 100 is depicted. This view shows the second yoke portion 116 more clearly. The second yoke portion 116 is connected to the second connection portion 106 through the kingpin 136. The kingpin 136 is rotatably connected to the truck plate 104.

Figure 5:
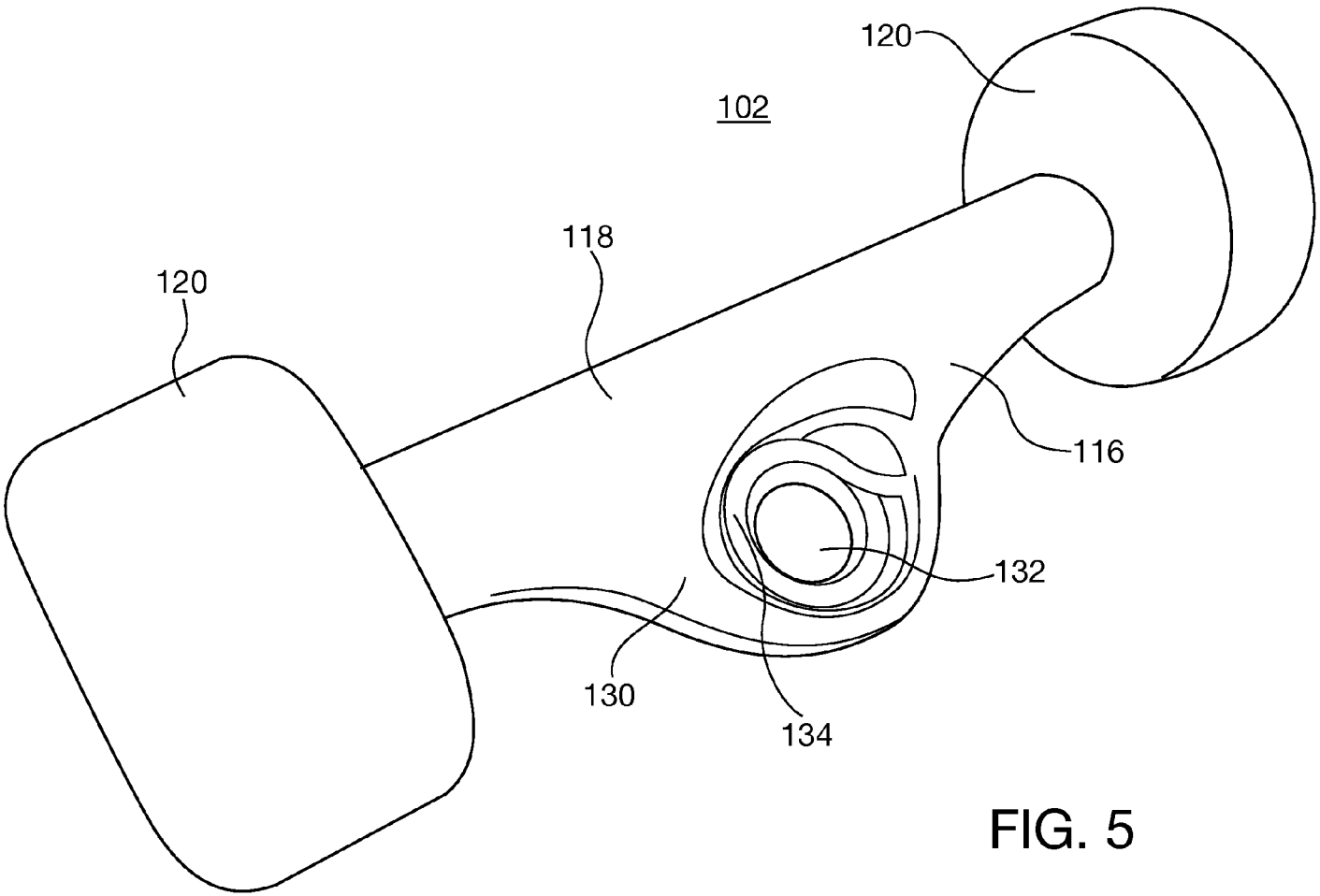
FIG. 5 depicts a second side view of an exemplary embodiment of a skateboard truck yoke.

Referring now to FIG. 5, a second side view of an exemplary embodiment of the skateboard truck yoke 117 is depicted. The second yoke portion 116 is shown more clearly in this view also. In the depicted embodiment, the second yoke portion 116 includes a main portion 130. The main portion 130 includes an aperture 132 and a recessed area 134.

Referring back to FIG. 4, the kingpin 136 extends from the plate 104 along axis B, connecting the second connection portion 106 with the second yoke portion 116. The kingpin 136 extends through a first bushing 140 securing the first bushing 140 in the recessed area 134. The first bushing may include an elastic material.

The kingpin 136 extends through a second bushing 142 securing the second bushing 142 between the second connection surface 158 and the second yoke portion 116. The second bushing 142 may include an elastic material.

The kingpin 136 extends through a metal cap 152 adjacent the second bushing 142. A nut 138 secured to the end of the kingpin 136 secures the connection of the second connection portion 106, the second yoke portion 116, the first bushing 140, the second bushing 142, and the cap 152.

The first bushing 140 and the second bushing 142 may include any device or combination of devices, which separate the faces of two solid objects whilst still allowing a set degree of movement. This movement minimizes transmission of noise and small vibrations through the truck 100.

As the coil spring 126 compresses and expands, and the protruding member 124 slides up and down in the first plate aperture 128, the kingpin 136 may rotate around axis C. Axis C may go through the center of the T end 135 of the kingpin 136.

In alternative embodiments the kingpin 136 may be rotatably connected to the plate 104 in alternative methods which would be known by an ordinary person skilled in the art.

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A skateboard truck for mounting to the underside of a skateboard deck to which wheels may be attached, comprising:

a truck plate comprising a base comprising a front surface and a back surface, a first connection portion including a first truck plate aperture and a second connection portion including a second truck plate aperture, which said first connection portion and second connection portion both protrude from the front surface of the base, and a plurality of bolt apertures for securing the plate to the skateboard deck;

a hanger further comprising a yoke including a middle portion having an aperture for surrounding an axle, a generally triangular main portion projecting from the middle portion and bearing a protruding member comprising an elongated generally cylindrical member, and a flange bearing an aperture;

a shock absorber comprising a spring disposed to surround the protruding member; and a king pin assembly comprising a bolt having a proximal end forming a T-end and a distal end bearing threads, at least one bushing, a metal cap, and a nut, wherein the first connection portion of the plate bears a truck plate aperture which is dimensioned and configured to receive the protruding member of the hanger, the first connection portion of the base bears a first plate aperture which is slot shaped and which is transversely aligned relative to the length of the base, and the second connection portion of the base bears a front aperture section and a back aperture section which has a configuration of a slot superimposed over a generally circular form with a diameter larger than the length of a straight line drawn across any part of the cross section of the front aperture section such that the T-end of the king pin may be inserted through the back aperture section.

* * * * *